United States Patent [19]

Owaki et al.

[11] 4,065,698

[45] Dec. 27, 1977

[54] GAS DISCHARGE DISPLAY DEVICE INCLUDING PLURALITY OF DISCHARGE PANEL UNITS WITH INTERMEDIATE LIGHT ABSORBING PLATES

[75] Inventors: Kenichi Owaki; Shizuo Ando; Norihiko Nakayama, all of Kobe, Japan

[73] Assignee: Fujitsu Limited, Kawasaki, Japan

[21] Appl. No.: 719,700

[22] Filed: Sept. 2, 1976

Related U.S. Application Data

[63] Continuation of Ser. No. 316,020, Dec. 18, 1972, abandoned.

[51] Int. Cl.[2] ..... H01J 61/35; H01J 61/42

[52] U.S. Cl. ..... 313/489; 313/112; 313/201; 313/220; 313/493

[58] Field of Search ..... 313/485, 489, 493, 112, 313/188, 201, 220; 315/169 TV

[56] References Cited

U.S. PATENT DOCUMENTS

| | | | |
|---|---|---|---|
| 2,447,322 | 8/1948 | Fonda | 252/301.6 S |
| 2,933,648 | 4/1960 | Bentley | 315/169 TV |
| 3,559,190 | 1/1971 | Bitzer et al. | 313/201 X |
| 3,562,737 | 2/1971 | Wiederhorn et al. | 315/169 R X |
| 3,573,459 | 4/1971 | Siegmund | 350/96 X |
| 3,626,241 | 12/1971 | Ngo | 313/112 X |
| 3,686,686 | 8/1972 | Hall | 315/169 R X |

*Primary Examiner*—Palmer C. Demeo
*Attorney, Agent, or Firm*—Daniel Jay Tick

[57] ABSTRACT

A gas discharge display device of multilayer structure comprises a plurality of discharge panel units in stacked relation to each other. Ultraviolet ray absorption layers are located between the discharge panel units. Phosphorescent material emits light of different brightness in proportion to the volume of ultraviolet rays from each discharge panel unit which rays excite such phosphorescent material. The phosphorescent material is supported on the discharge panel unit on the display surface side of the device.

2 Claims, 6 Drawing Figures

FIG. 3
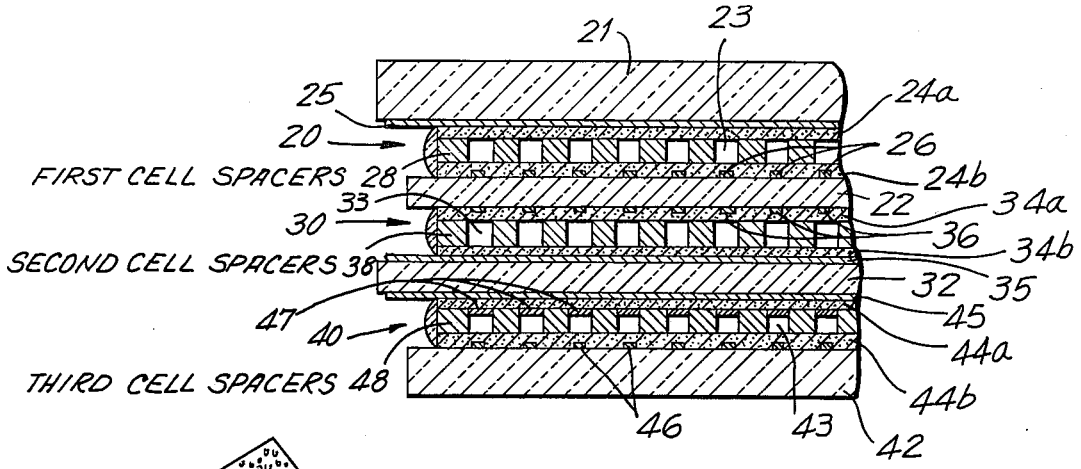
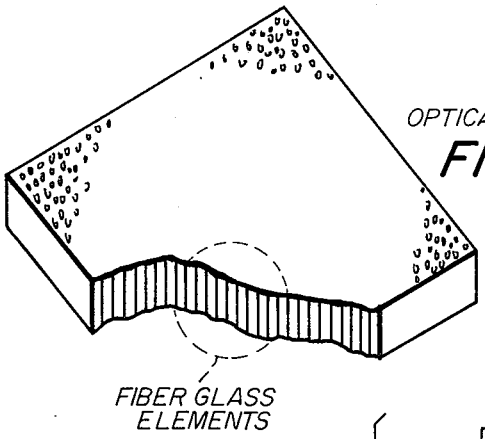
FIG. 5
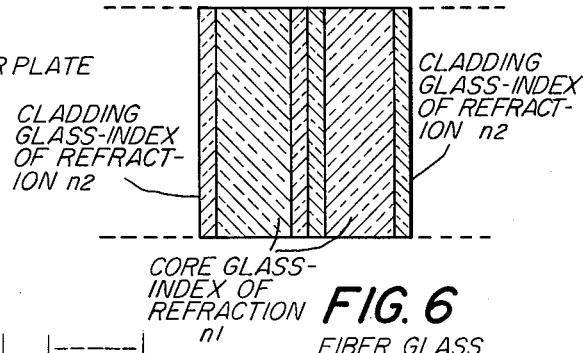
FIG. 6
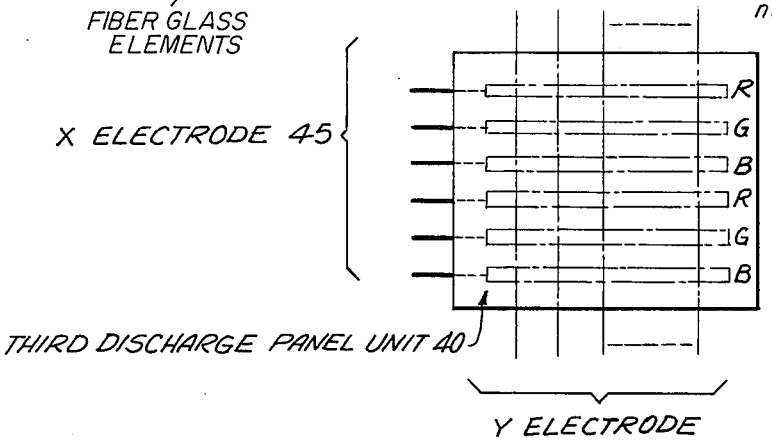
FIG. 4

GAS DISCHARGE DISPLAY DEVICE INCLUDING PLURALITY OF DISCHARGE PANEL UNITS WITH INTERMEDIATE LIGHT ABSORBING PLATES

BACKGROUND OF THE INVENTION

This is a Continuation of application Ser. No. 316,020, filed Dec. 18, 1972 for GAS DISCHARGE DISPLAY DEVICE, and now abandoned.

The present invention relates to a gas discharge display device. More particularly, the invention relates to a gas discharge display device which combines phosphorescent material with a multilayer structure of a plurality of discharge panel units and may vary the tones of brightness of visible light produced.

Gas discharge display devices which are well known as plasma display panels have been utilized primarily for displaying letters, figures or symbols. However, the application of such display panels for displaying a picture with a half tone has been considerably enhanced since the recent development of technical means for changing the tones of brightness. The techniques which have been developed thus far for varying the tones of brightness are roughly divided into the following three methods.

The first method is for controlling the number of times of discharge in accordance with the wave shape of the sustaining signal provided from the outside. This is described in a thesis of the Society For Information Display International Symposium, May 4–6, 1971, entitled, "A Gray-Scale Technique For A Plasma Display Panel And Similar On-Off Devices" by M. Dejule et al. The first method, however, often makes the structure of the control circuit very complex and also makes the operation unstable.

The second method is for structurally providing the weight of luminous brightness beforehand to each picture element of the gas discharge display device. This is disclosed, for example, in FIG. 21 and the corresponding description thereof in U.S. Pat. No. 3,559,190. Disadvantages of the second method, however, are a decrease in the resolution because of enlarged picture elements and obscuring off the distinction of the tones.

The third method is for stacking a plurality of discharge panel units with optical attenuating films and obtaining multitones with the combination of the attenuated discharge light from each discharge panel unit. The third method is disclosed in a thesis of the Society For Information Display International Symposium, May 4–6, 1971, entitled "Gray-Scale Plasma Display" by D. T. Ngo, I.D.S., 1971, pages 100 and 101. The disadvantage of the third method, however, is that it produces parallax in the display.

The principal object of the invention is to provide a gas discharge display device of new and improved type which eliminates the disadvantages of the known devices.

An object of the invention is to provide a gas discharge display device which is of simple structure and provides variable tones of brightness.

Another object of the invention is to provide a gas discharge display device which provides multitones of high resolution without parallax.

Still another object of the invention is to provide a gas discharge display device which provides a half tone of high resolution.

Yet another object of the invention is to provide a gas discharge display device of multilayer structure for varying the tones of brightness and having considerably decreased parallax.

Another object of the invention is to provide a gas discharge display device of multilayer structure which provides a color display of half tone.

An object of the invention is to provide a gas discharge display device which functions efficiently, effectively, and reliably.

BRIEF SUMMARY OF THE INVENTION

In accordance with the invention, a gas discharge display device comprises a plurality of discharge panel units in stacked relation to each other. Each of the discharge panel units has a discharge space formed therein and separately controlled addressable electrodes on opposite sides of the discharge space. Phosphorescent material is provided in a discharge space on a wall bordering the discharge space of one of the panel units. A plurality of control elements are positioned between the discharge panel units thereby varying the volume of light arriving at the phosphorescent material from each of the discharge spaces and especially the volume of ultraviolet or infrared light of the luminous discharge spectra.

BRIEF DESCRIPTION OF THE DRAWINGS

In order that the invention may be readily carried into effect, it will now be described with reference to the accompanying drawing, wherein:

FIG. 3 is a sectional view of part of another embodiment of the gas discharge display device of the invention;

FIG. 4 is a plan view of a modification of the embodiment of FIG. 3 for providing a color display.

FIG. 5 is a cutaway view, on an enlarged scale, of an optical fiber plate; and FIG. 6 is a view, on an enlarged scale, of fiber glass elements of the optical fiber plate of FIG. 5.

In the FIGS., the same components are identified by the same reference numerals.

DETAILED DESCRIPTION OF THE INVENTION

Figure 1:
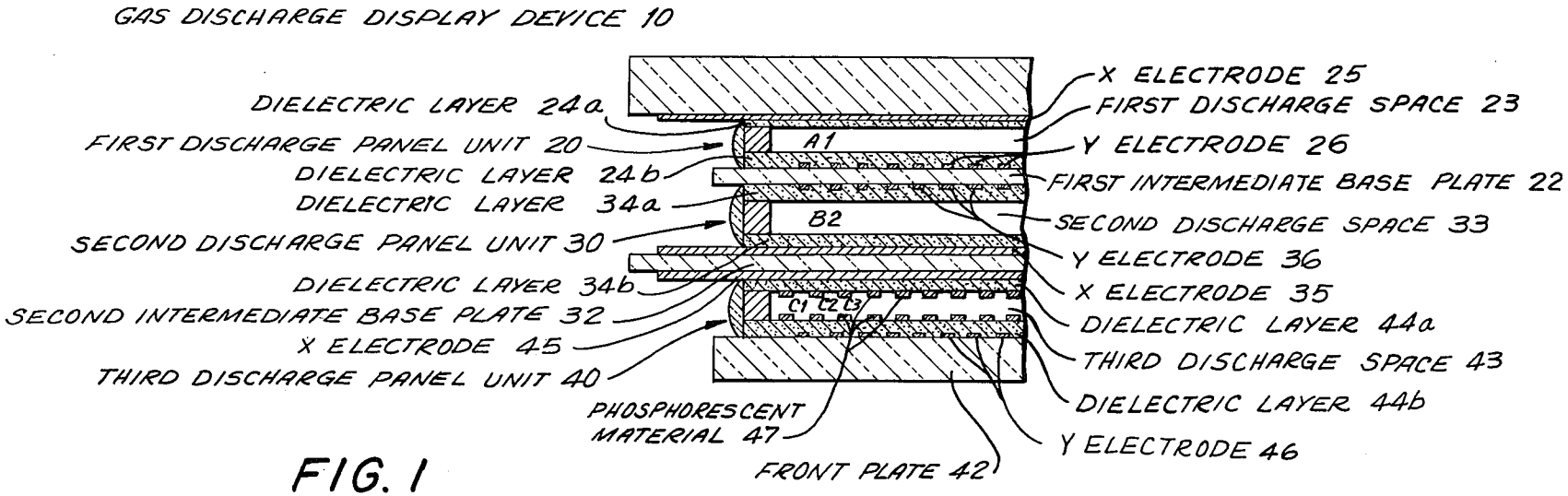
FIG. 1 is a sectional view of part of an embodiment of the gas discharge display device of the invention.

The gas discharge display device 10 of FIG. 1 comprises a unitary multilayer structure consisting of a first discharge panel unit 20, a second discharge panel unit 30 and a third discharge panel unit 40. The first discharge panel unit 20 is provided with a comparatively thick glass back plate 21 and a glass intermediate base plate 22. The intermediate base plate 22 functions as a first ultraviolet ray absorption layer. The first discharge panel unit has a first discharge space 23 formed therein wherein a gas mixture of helium and xenon is provided. The gas material of helium and xenon thus fills the gap between the back plate 21 and the first intermediate base plate 22.

Separately addressable electrodes are provided on opposite surfaces of the back plate 21 and the first intermediate base plate 22. A X electrode 25 is thus provided on the surface of the back plate 21 facing the first intermediate base plate 22 and a Y electrode 26 is provided on the surface of said first intermediate base plate facing said back plate. The X electrode 25 is covered with a first dielectric layer 24*a* and the Y electrode 26 is covered with a dielectric layer 24*b*.

The second discharge panel unit 30 is positioned next adjacent to and beneath the first discharge panel unit 20. The second discharge unit 30 utilizes the first intermediate base plate 22 and a second intermediate base plate 32. Each of the first and second intermediate base plates 22 and 32 functions as an ultraviolet ray absorption layer. The second discharge panel unit 30 has a second discharge space 33 formed therein and filled with a gas mixture of helium and xenon. The gas mixture of helium and xenon fills the gas between the first and second intermediate base plates 22 and 32.

An addressable X electrode 35 is provided on the surface of the second intermediate base plate 32 facing the first intermediate base plate 22. An addressable Y electrode 36 is provided on the surface of the first intermediate base plate 22 facing the second intermedite base plate 32. The Y electrode 36 is covered with a dielectric layer 34a and the X electrode 35 is covered with a dielectric layer 34b.

The third discharge panel unit 40 is positioned on the display surface side of the device between the second intermediate base plate 32 and a front plate 42. The third discharge panel unit has a third discharge space 43 formed therein. A gas mixture of helium and xenon is provided in the third discharge space 43 and fills and gap between the second intermediate base plate 32 and the front plate 42.

An addressable X electrode 45 is provided on the surface of the second intermediate base plate 32 facing the front plate 42. An addressable Y electrode 45 is provided on the surface of the second intermediate base plate 32 facing the front plate 42. An addressable Y electrode 46 is provided on the surface of the front plate 42 facing the second intermediate base plate 32. The X electrode 45 is covered with a dielectric layer 44*a* and the Y electrode 46 is covered with a dielectric layer 44*b*.

Phosphorescent material 47 is sprayed in a dot pattern on the surface of the dielectric layer 44a and on the surface of the dielectric layer 44*b*. The phosphorescent material 47 is exposed in the third discharge space 43 in a manner whereby it is positioned at places other than those at which the X and Y electrodes 45 and 46 are positioned, as shown in FIG. 1. The phosphorescent material 47 thus deviates in position from the X and Y electrodes 45 and 46.

In the embodiment of FIG. 1, the phosphorescent material 47 emits ultraviolet to visible transmission. Phosphorescent material varies the luminous brightness in accordance with the volume of ultraviolet rays impinging thereon. Suitable phosphorescent material of this type may comprise for example, green luminous phosphorescent material, such as, zinc oxide or zinc silicate or the like.

Figure 2:
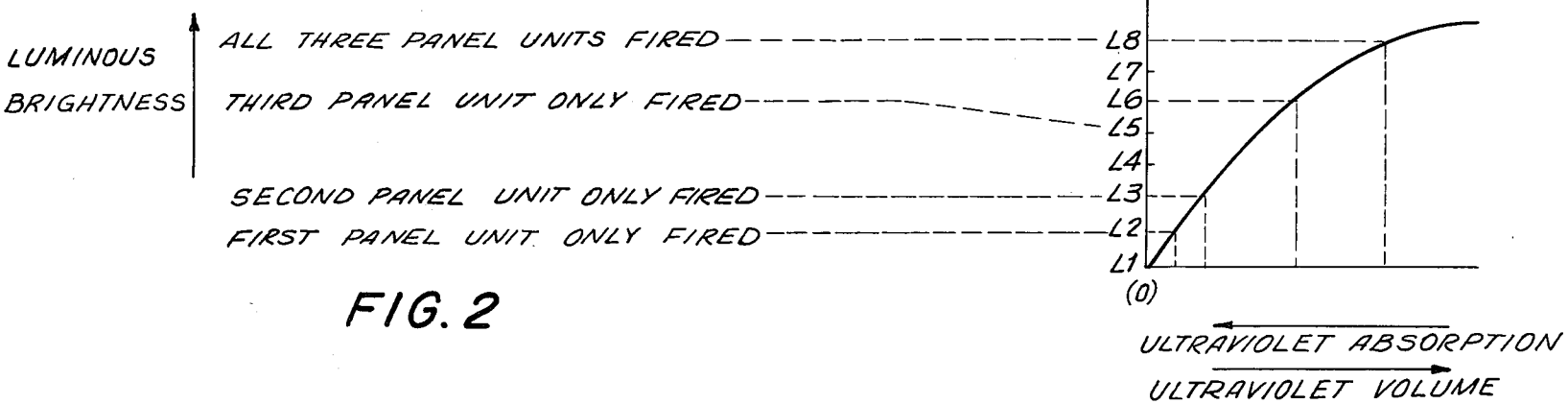
FIG. 2 is a graphical presentation illustrating the relation of the volume of ultraviolet excitation light to the luminous brightness.

The general relation of the luminous brightness produced by the phosphorescent material 47 to the volume of impinging ultraviolet light rays is shown in FIG. 2.

In FIG. 2, the abscissa represents ultraviolet absorption in the direction from right to left moving toward the original point and represents ultraviolet volume in the direction from light to right moving away from the original point. The ordinate represents luminous brightness. In the gas discharge display device, as shown in FIG. 1, when a firing voltage is applied between a segment of the X electrode 25 and a segment of the Y electrode 26, it intersects at a point A1 (FIG. 1) thereby addressing to the point A1 of the first discharge panel unit 20, ultraviolet light rays produced by the discharge at the point A1. The thus produced ultraviolet rays pass through areas of the first and second intermediate base plates 22 and 32 and excite the point C1 (FIG. 1) corresponding to the point A1. The point C1 is located between segments of the phosphorescent material 47. The first and second intermediate base plates 22 and 32 provide an ultraviolet ray absorption and produce visible light rays having a brightness L2, as shown in FIG. 2.

When a point B2 (FIG. 1) of the second discharge panel unit 30 is addressed, ultraviolet light rays produced by the discharge excite the corresponding point C2 (FIG. 1) between segments of the phosphorescent material 47. In this case, the ultraviolet light is attenuated only by the second intermediate base plate 32, instead of both the first and second intermediate base plates 22 and 32, as in the case of a discharge at the point A1, as hereinbefore described. The ultraviolet light impinging upon the phosphorescent material 47 thus produces an emission of light having a brightness L3, as shown in FIG. 2. Since the brightness L3 of phosphorescent emission at the point C2 is produced by excitation by ultraviolet light of greater volume than the volume of ultraviolet light from the point A1, such phosphorescent emission is brighter than that at the point C1.

When the point C3 (FIG. 1) of the third discharge panel unit 40 is addressed, ultraviolet rays produced by the discharge directly excite the segments of phosphorescent material 47 at the point C3. The emission of light at the point C3 thus has a greater brightness L5 as shown in FIG. 2.

Thus, the gas discharge display device of the embodiment of FIG. 1 of the invention may provide light emission having a brightness of eight tones varying from L1 to L8 of the phosphorescent material 47. The various tones of brightness are provided by suitable combination and selective addressing of the first, second and third discharge panel units 20, 30 and 40. Sixteen tones may be provided by utilizing a fourth discharge panel unit to provide a total of four discharge panel units in the gas discharge display device 10.

The gas utilized to fill the first, second and third discharge spaces 23, 33 and 43 is preferably a mixture of helium and xenon or helium and kryton. These gas mixtures have comparatively low firing voltage characteristics and provide an emission spectrum having a concentrated distribution at an ultraviolet region and an infrared region, excepting a visible region. The three discharge spaces 23, 33 and 43 need not be independently enclosed, as illustrated in FIG. 1, but may be interconnected. Thus, for example, holes may be provided in the intermediate base plates 22 and 32 to interconnect the discharge spaces 23, 33 and 43. The holes in the intermediate base plates 22 and 32 are preferred, since they may be provided by a simple process of manufacture.

There may be a problem of cross-talk due to the discharge of adjacent address points. However, the substantial thickness of the operating parts of the gas discharge display device of the embodiment of FIG. 1 may be made less than 5 mm, due to the gap distance of about 200 microns between discharge spaces. The influence of cross-talk is thus practically eliminated. However, in order to solve the problem of cross-talk by total elimination thereof, cell spacers having a plurality of small holes corresponding to each opposite intersecting point of the X and Y address electrodes may be provided in the discharge spaces 23, 33 and 43. Simultaneously, the diffusion of ultraviolet rays in the direction of the surface may be prevented by utilizing optical guide plates such as, for example, optical fiber plates, or the like, as the first and second intermediate base plates 22 and 32. The optical fiber plates may be of any suitable known type such as, for example, those described in U.S. Pat. No. 3,253,896, issued May 31, 1966 to Woodcock.

An optical fiber plate is shown in FIG. 5. FIG. 6 shows fiber glass elements of the optical fiber plate.

The embodiments of FIG. 3 of the gas discharge display device of the invention is of substantially the same structure as the embodiment of FIG. 1, with the exception of some additional components, as hereinafter described. The similar components of FIGS. 1 and 3 are similarly identified by the same reference numerals. In the embodiment of FIG. 3, three pluralities of cell spacers having small holes arranged therein optically divide the addressable points of the electrodes of the discharge panel units. A first plurality of cell spacers 28 are provided in the first discharge space 23 and optically divide the addressable points of the X and Y electrodes 25 and 26. A second plurality of cell spacers 38 are provided in the second discharge space 33 and optically divide the addressable points of the X and Y electrodes 35 and 36. A third plurality of cell spacers 48 are provided in the third discharge space 43 and optically divide the addressable points of the X and Y electrodes 45 and 46.

In the embodiment of FIG. 3, the first and second intermediate base plates 22 and 32, which function as ultraviolet ray absorption layers, comprise optical fiber plates. The optical fiber plates may comprise any suitable known type such as, for example, those described in the aforedescribed Woodcock patent. As shown in FIGS. 5 and 6, an optical fiber plate comprises a plurality of layers of core glass. Each layer of core glass is bordered on both sides by cladding glass. The cladding glass bordered next-adjacent layers of core glass is in juxtaposition. The core glass has an index of refraction nl which is greater than the index of refraction n2 of the cladding glass. The phosphorescent material 47, in the embodiment of FIG. 3, is provided on the rear side wall of the third discharge panel unit 40, in the third discharge space 43, and is placed on the display surface side, which is the dielectric layer 44*a*, only. This arrangement of the phosphorescent material 47 is very effective in decreasing parallax.

A simple structure of the first and second intermediate base plates 22 and 32 for providing ultraviolet ray absorption layers is soda-lime glass. It may also be considered that the function of ultraviolet ray absorption is undertaken by the dielectric layers covering each of the X and Y electrodes. It is, of course, possible to include an additional ultraviolet ray absorption layer in the device in the form of a film of suitable material.

The aforedescribed devices provide unicolor displays. The principle of the invention may be equally well applied to a gas discharge display device which provides a color display.

FIG. 4 is a schematic diagram of a modification of the gas discharge display device of the invention which provides a color display. The modification of FIG. 4 differs from the embodiment of FIG. 1 only in the arrangement of the phosphorescent material. More particularly, the phosphorescent material 47 is provided in the third discharge panel unit 40 and is placed on the display surface side of said discharge panel unit. The phosphorescent material 47 comprises three types which emit red, green and blue light. The phosphorescent material 47 is strips R emits red light. The phosphorescent material 47 in strips G emits green light. The phosphorescent material 47 in strips B emits blue light. The strips R, G and B of phosphorescent material are sequentially placed on the X electrode 45.

For each additional point of the strips R, G and B of the phosphorescent material, half tones of brightness may be provided by selectively combining the address of the discharge panel units, as hereinbefore described. The desired color display may therefore be provided by addressing in linear sequence along the strips of phosphorescent material.

Further modifications of the gas discharge display device of the invention may be provided. Thus, for example, infrared light rays may be utilized in the discharge emission spectrum for exciting the phosphorescent material. In this case, the infrared ray absorption layers are provided between the discharge panel units. Furthermore, luminescent phosphorescent material, known for its infrared to visible light transformation characteristics, which emits visible light when excited by infrared light, is utilized as the phosphorescent material. The advantage of the use of infrared light rays is that such light is invisible and does not influence the display.

Another modification may be provided by utilizing direct discharge type discharge panel units having exposed addressable electrodes in the discharge spaces.

The X and Y address or addressable electrodes are not limited to the form of grids or matrices illustrated herein and positioned opposite each other on both sides of each discharge space. The X and y electrodes may be provided on the wall surface of but one side of each discharge panel unit in the discharge space thereof, in isolated relation to each other.

Still another modification may be provided in connection with a forming position of the phosphorescent material. Thus, for example, the phosphorescent material may be formed between the dielectric layer 446 and the front plate 42 or the second intermediate base plate 32. Furthermore, the front plate 42 may comprise two glass plates having the phosphorescent material between them.

In each of the aforedescribed types of gas discharge display device, the tones may be increased by operating each discharge panel unit a different numbers of times per unit time. The combination of the gas mixture in the discharge space may be varied beforehand to provide different quantities of emitted light from each discharge panel unit.

The gas display device of the invention is of simple structure, provides variable tones of brightness and provides multitone displays of high resolution, without parallax. Furthermore, as hereinbefore described, the gas discharge display device of the invention may be readily modified to provide a color display.

While the invention has been described by means of specific examples and in specific embodiments, we do not wish to be limited thereto, for obvious modifications will occur to those skilled in the art without departing from the spirit and scope of the invention.

We claim:

1. A gas discharge display device having a display surface side, said gas discharge display device comprising a plurality of intermediate plates having light absorbing characteristics, each of the intermediate plates having a pair of spaced opposite surfaces;

a plurality of discharge panel units in stacked relation to each other, each of the intermediate plates being positioned between a corresponding one of the discharge panel units and a corresponding next-adjacent one of the discharge panel units, each of the intermediate plates having one electrode on one of the surfaces thereof for addressing one of the discharge panel units and another electrode on the other of the surfaces thereof for addressing another of the discharge panel units, each of the discharge panel units having an envelope including an intermediate plate, a discharge sustaining gas therein, a discharge space formed therein, a rear side wall in the discharge space and addressable row and column electrodes on opposite sides of the discharge space, at least one of which is on the intermediate plate; and phosphorescent material on the rear side wall in the discharge space on one of the discharge panel units on the display surface side of the device, the phosphorescent material emitting visible light rays upon excitation by discharged light from the discharge panel units whereby the phosphorescent material emits light at an intensity proportional to the volume of light reaching said phosphorescent material from each of the discharge spaces through the intermediate plates.

2. A gas discharge display device as claimed in claim 1, wherein each of the intermediate plates comprises an optical fiber plate.

* * * * *